US006444000B1

(12) United States Patent
Firey

(10) Patent No.: US 6,444,000 B1
(45) Date of Patent: Sep. 3, 2002

(54) STEAM DRIVEN FUEL SLURRIFIER

(76) Inventor: Joseph Carl Firey, P.O. Box 15514, Seattle, WA (US) 98115-0514

( * ) Notice: Subject to any disclaimer, the term of this patent is extended or adjusted under 35 U.S.C. 154(b) by 0 days.

(21) Appl. No.: 09/699,327

(22) Filed: Oct. 30, 2000

Related U.S. Application Data

(63) Continuation-in-part of application No. 09/312,500, filed on May 17, 1999, now abandoned.

(51) Int. Cl.[7] ..... C10L 1/32
(52) U.S. Cl. ..... 44/639; 44/301
(58) Field of Search ..... 44/629, 301, 639

(56) References Cited

U.S. PATENT DOCUMENTS 4,592,328 A * 6/1986 Firey ..... 123/531

* cited by examiner

*Primary Examiner*—Cephia D. Toomer

(57) ABSTRACT

A steam fuel slurrifier is described wherein a jet of liquid fuel is intersected by a jet of wet steam to atomize the liquid fuel into many small droplets, each coated with a film of liquid water. Water is then added to this mixture to create a slurry of liquid fuel droplets suspended in a continuous liquid water phase. By thusly preatomizing the liquid fuel, high viscosity and residual type fuels can be efficiently burned in medium and small bore diesel engines.

10 Claims, 5 Drawing Sheets

STEAM DRIVEN FUEL SLURRIFIER

CROSS REFERENCE TO RELATED APPLICATIONS

This application is a continuation-in-part of my earlier filed U.S. patent application, Ser. No. 09/312,500 filed May 17, 1999 entitled "Steam Fuel Slurrifer," now abandoned.

The invention described herein is related to my earlier filed U.S. patent application entitled, "*Fuel Injector for Slurry Fuels,*" Ser. No. 09/146,901 filed Sep. 4, 1998, now issued as U.S. Pat. No. 5,931,123, on Aug. 3, 1999.

BACKGROUND OF THE INVENTION

1. Field of the Invention

This invention is in the field of slurry fuels of liquid fuel particles, suspended in liquid water, for use in engines and burners.

2. Description of the Prior Art

Many kinds of liquid fuels are presently burned efficiently in diesel engines, particularly, but not exclusively, petroleum derived fuels. These petroleum derived fuels vary widely in viscosity, and hence in ease with which the liquid fuel, injected into the engine cylinder prior to combustion, can be atomized into the very small droplets needed for efficient combustion. As fuel viscosity increases, higher fuel injection pressures are needed for adequate atomization, and the fuel spray path length needed also increases. As a result, high viscosity fuels, such as petroleum residual fuels, can only be burned efficiently in diesel engines of large piston diameter, of the order of two to three feet. When such residual fuels are used in medium and small bore engines, either fuel atomization is inadequate, or the liquid fuel is sprayed onto the cylinder wall, and inefficient combustion results.

A method for efficiently burning these high viscosity, and low cost, fuels in medium and small bore diesel engines would be very useful.

3. Definitions

Those liquid fuels which are largely, or essentially completely, insoluble in water, are suitable for the purposes of this invention. Preferably the vapor pressure of these liquid fuels is very low at the temperature of boiling water at one atmosphere ambient pressure. Most such fuels in common use are derived from crude petroleum, as for example, residual fractions left after refined portions, such as gasoline, diesel fuel, and lubricating oil fractions have been removed from the crude oil. Some high viscosity, low vapor pressure, liquid fuels can be derived from non-petroleum sources, such as vegetable oils, coal tar derivatives, wood tar derivatives, etc.

The term water is used herein and in the claims to mean a chemical comprising, principally, molecules containing two atoms of hydrogen and one atom of oxygen, i.e., $H_2O$. The term liquid water is used herein and in the claims to mean water in the liquid state. The term steam is used herein and in the claims to mean water in the vapor state. The term wet steam is used herein and in the claims to mean a mixture of steam and liquid water.

The term slurry fuel is used herein and in the claims to mean a mechanical mixture of a liquid fuel in liquid water, wherein the fuel is largely insoluble in water.

The term wet steam is used herein and in the claims to mean a mechanical mixture of water vapor and liquid water at essentially the same temperature.

The term trajectory is used herein and in the claims to mean the line, either straight or curved, that a moving mass describes in space.

SUMMARY OF THE INVENTION

A steam fuel slurrifier of this invention comprises a liquid fuel nozzle and a wet steam nozzle, which create a liquid fuel jet and a counterflowing steam jet. The steam jet intersects the fuel jet and atomizes the liquid fuel into many small droplets within an atomization chamber. Heat transferred from the steam to the fuel causes steam condensation on the fuel droplet surface, which becomes coated with liquid water. This mixture of liquid fuel and steam moves out of the atomization chamber into a surrounding and rotating mixer chamber, into which additional mixer water is added, to create a liquid fuel in liquid water slurry, wherein liquid water is the continuous phase. Centrifugal force caused by rotation of this slurry within the mixer chamber, keeps the slurry outside of the atomization chamber where it would interfere with atomization. The resulting slurry of small liquid fuel droplets suspended in a continuous liquid water phase can be removed from the mixer chamber and used subsequently as a slurry fuel in conventional diesel engines. By thusly preatomizing the liquid fuel outside of the diesel engine, high viscosity fuel such as petroleum residual fuels can be efficiently burned in medium and small bore engines. These engines cannot otherwise efficiently use such high viscosity fuels due to inadequate fuel spray path length for the needed fine atomization. This is a principal beneficial object of this invention that low cost residual fuels can be efficiently utilized in medium and small bore diesel engines, by thusly preatomizing these high viscosity fuels outside the engine.

BRIEF DESCRIPTION OF THE DRAWINGS

A schematic, cross sectional view of an example form of a steam fuel slurrifier apparatus of this invention is shown in FIG. 1.

Another form of steam fuel slurrifier apparatus of this invention is shown partially and in cross section in FIG. 2.

Figure 3:
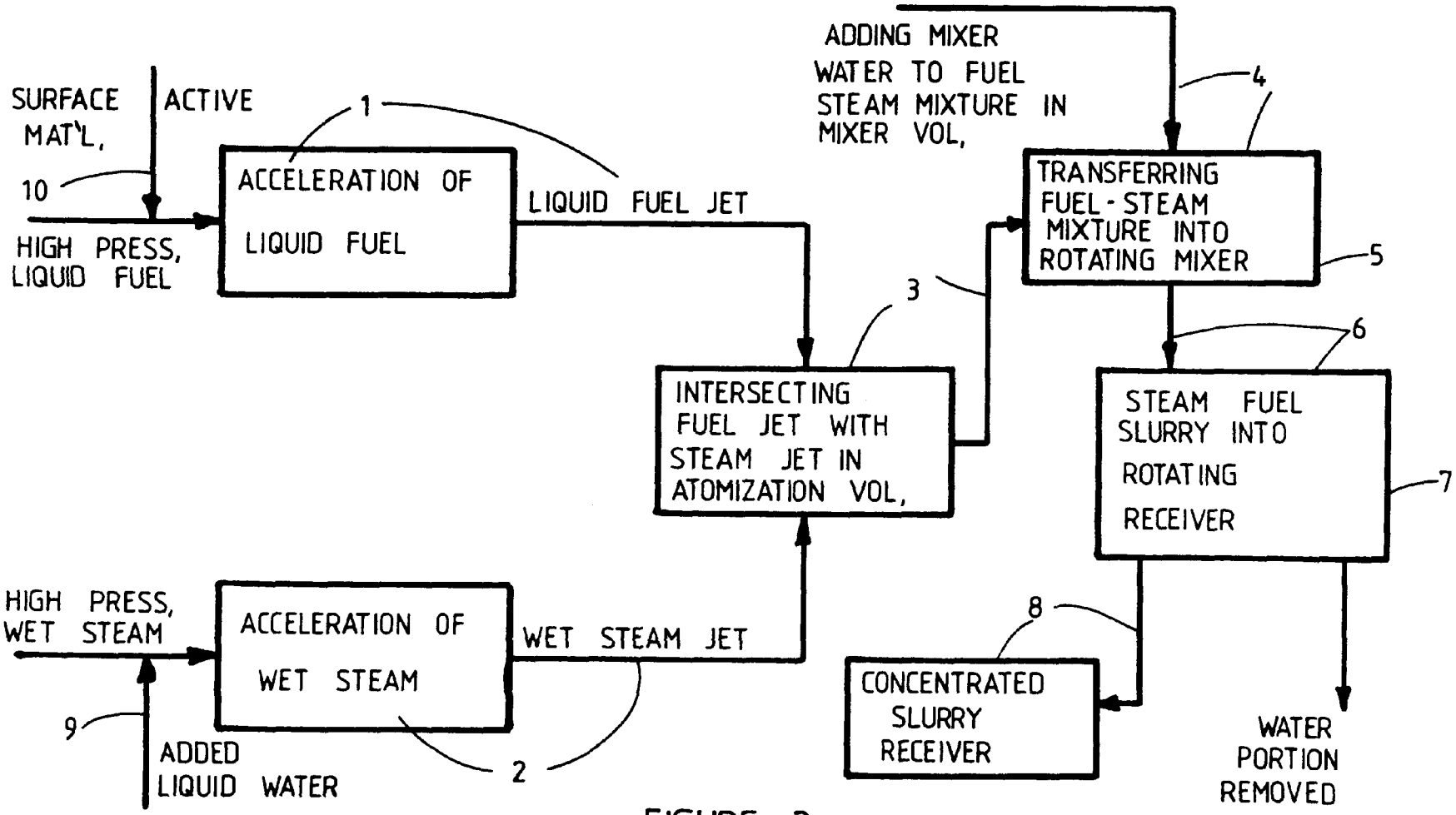

A schematic diagram of the process steps of a steam fuel slurrifier is shown in FIG. 3.

Figure 4:
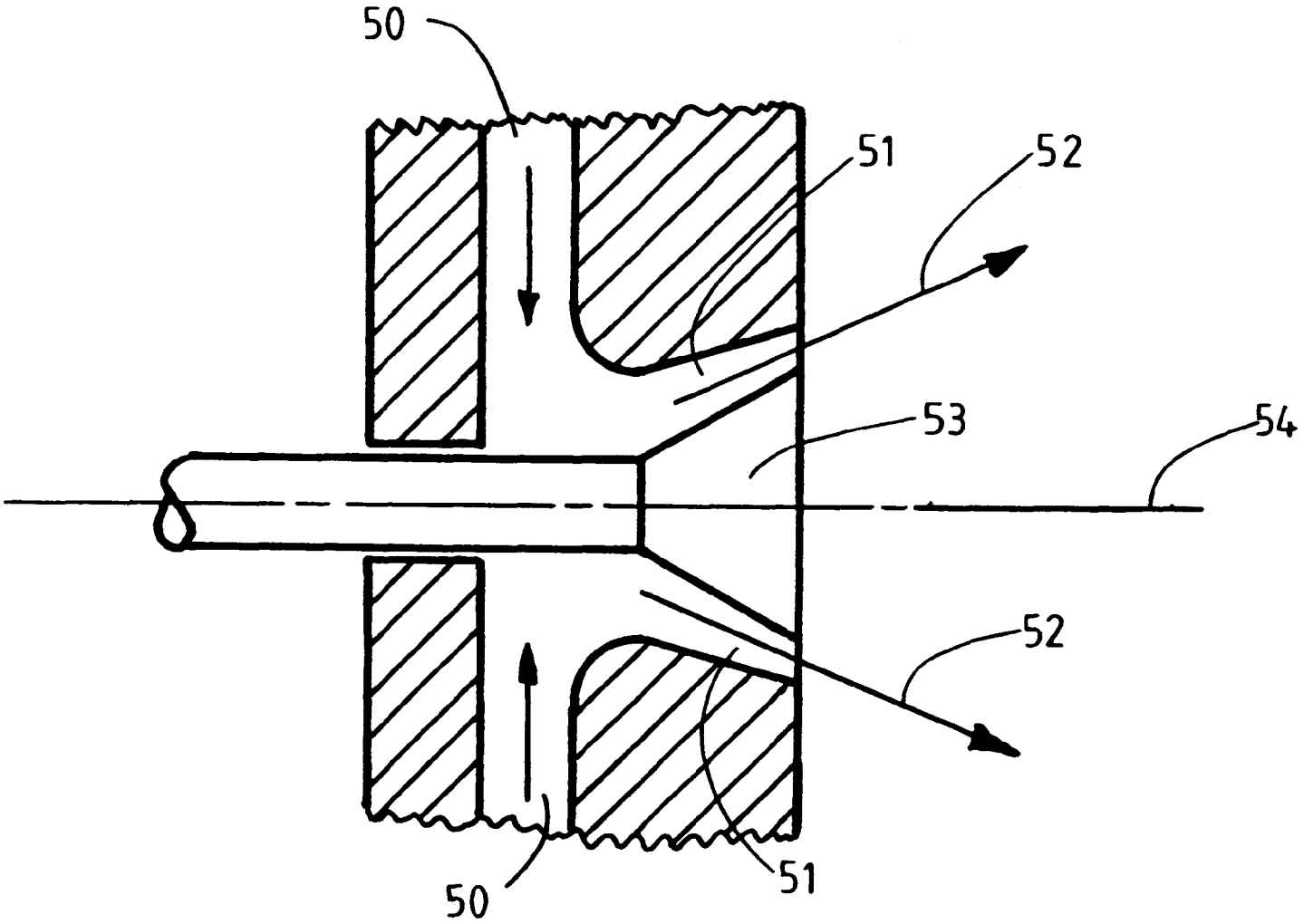

A schematic, cross sectional view of a fuel or steam nozzle for creating a hollow cone-shaped jet is shown in FIG. 4.

Figure 5B:
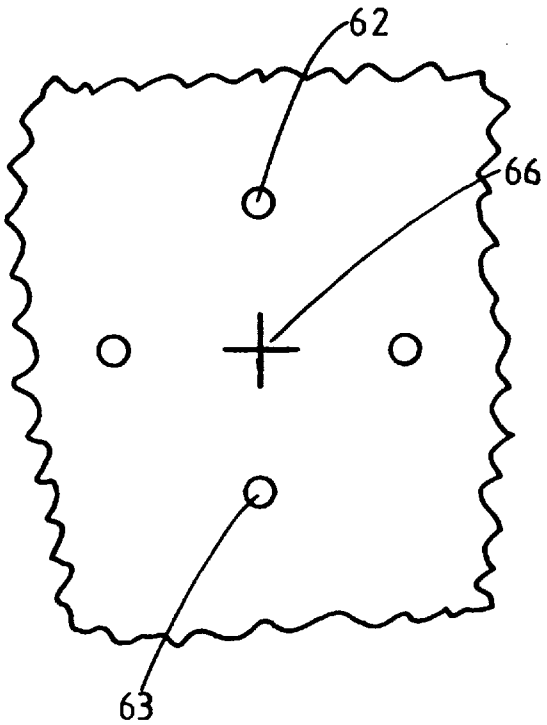
Figure 5A:
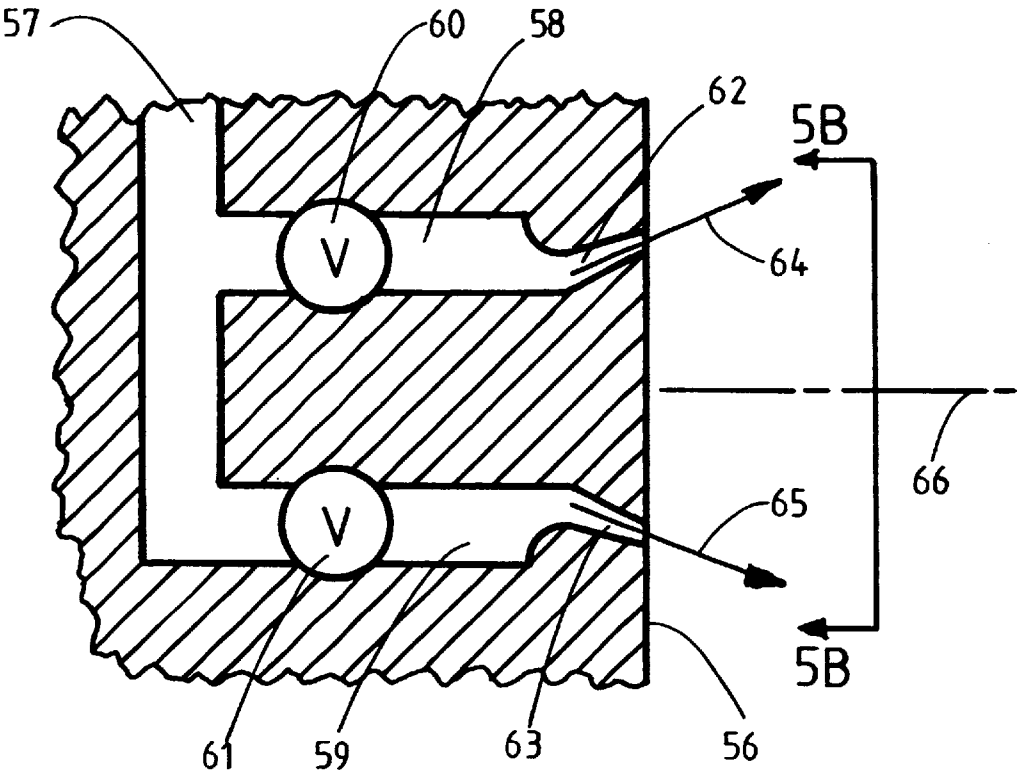

Two views of a multi-hole fuel or steam nozzle, with valves, is shown in FIG. 5A and FIG. 5B.

DESCRIPTION OF THE PREFERRED EMBODIMENTS

Figure 1:
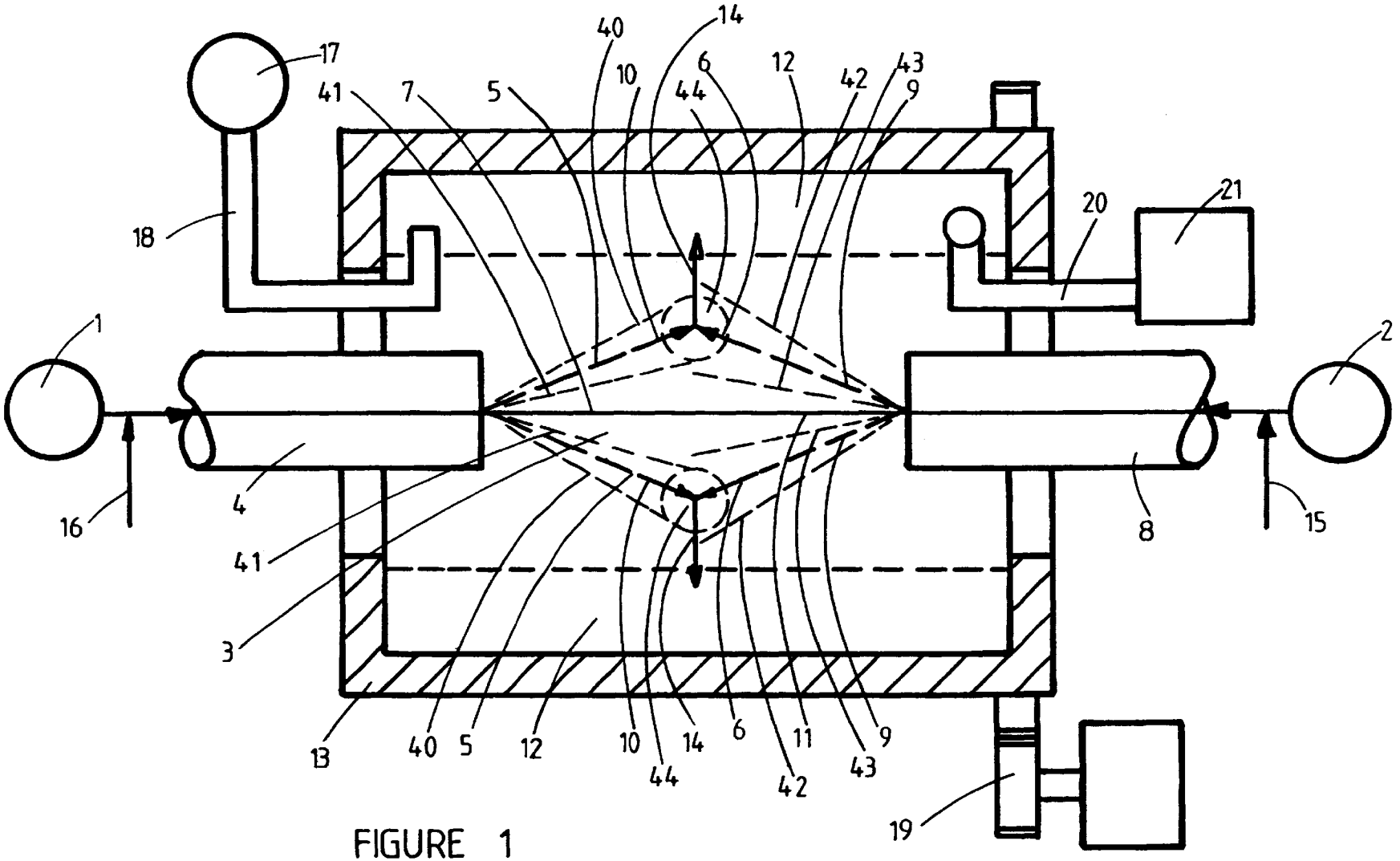

An example steam fuel slurrifier apparatus of this invention is shown schematically and in cross section in FIG. 1 and comprises:

1. A source of liquid fuel at high pressure, 1, such as a tank containing fuel and a high pressure liquid fuel pump;
2. A source of wet steam at high pressure, 2, such as a high pressure steam boiler with a feedwater source and high pressure feedwater pump;
3. An atomization chamber, 3, at a pressure less than that of the liquid fuel and the wet steam, such as at atmospheric pressure;
4. A liquid fuel nozzle, 4, which connects the liquid fuel source, 1, to the atomization chamber, 3, and injects the liquid fuel into the atomization chamber. The pressure difference between fuel source and atomization chamber acts to accelerate the fuel into a high velocity fuel jet, 5. The example fuel jet of FIG. 1 is a hollow conical sheet of liquid fuel, each portion of which has a trajectory line and direction of motion, such as shown by the arrows, 6. The example fuel jet of FIG. 1 has a centerline, 7, defined by the motion path of the center of mass of those liquid fuel portions which flowed concurrently through the liquid fuel nozzle, 4.

5. A steam nozzle, 8, which connects the steam source, 2, to the atomization chamber, 3, and injects the steam into the atomization chamber. The pressure difference between steam source and atomization chamber acts to accelerate the steam into a high velocity steam jet, 9. The example steam jet of FIG. 1 is a hollow conical sheet of steam, each portion of which has a trajectory line and direction of motion, such as shown by the arrows, 10. The example steam jet of FIG. 1 has a centerline, 11, defined by the motion path of the center of mass of those wet steam portions which flowed concurrently through the steam nozzle, 8.

6. A mixer chamber, 12, surrounds the atomization chamber, 3, and is open to the atomization chamber, and is enclosed by the mixer enclosure, 13.

7. The liquid fuel jet, 5, of FIG. 1, is a hollow conical sheet of liquid fuel, enclosed between the liquid fuel outer jet envelope, 40, and the liquid fuel inner jet envelope, 41, and all portions of the liquid fuel jet pass through the volume enclosed between these outer and inner liquid fuel jet envelopes.

8. The steam jet, 9, of FIG. 1, is a hollow conical sheet of wet steam, enclosed between the steam outer jet envelope, 42, and the steam inner jet envelope, 43, and all portions of the steam jet pass through the volume enclosed between these outer and inner steam jet envelopes.

9. The liquid fuel inner jet envelope, 41, encloses a finite volume whose cross-sectional area, across the liquid fuel jet centerline, 7, increases in the direction of liquid fuel motion, 6.

10. The steam inner jet envelope, 43, encloses a finite volume whose cross-sectional area, across the steam jet centerline, 11, increases in the direction of steam motion, 10.

11. The fuel nozzle, 4, and the steam nozzle, 8, are aligned relative to each other so that the trajectory, 6, of each portion of the liquid fuel jet, 5, is intersected by the trajectory, 10, of a portion of the steam jet, 9. The intersection of a liquid fuel trajectory, 6, and a wet steam trajectory, 10, terminates both trajectories, since the resulting liquid fuel atomization combines the fuel masses with steam masses to create a mixture of liquid fuel and wet steam, and scatters the motion paths, particularly radially outward from the centerline, 7, of the liquid fuel jet.

12. The volume of intersection, 44, encloses all those regions wherein liquid fuel trajectories are intersected by steam trajectories. The fuel nozzle, 4, and the steam nozzle, 8, are further aligned relative to each other so that the volume of intersection, 44, is entirely within the volume enclosed between the steam jet outer and inner envelopes, 42, 43.

13. The example nozzle, shown schematically in cross section, in FIG. 4, is suitable for creating a hollow conical jet of wet steam or liquid fuel, as shown in FIG. 1. The liquid fuel or wet steam enter via passage, 50, and accelerate through the annular, conical nozzle passage, 51, to create the diverging fuel trajectories, 52. The flow area of the nozzle passage, 51, can be adjusted by moving the conical flow divider, 53, along the jet centerline, 54, in order to increase or decrease the flow rate of liquid fuel or wet steam. The interior angle of the hollow conical fluid jet can be increased over that of the conical flow divider, 53, by use of fluid swirl vanes in the entry passage, 50.

14. An alternative example multi-hole nozzle is shown in cross section in FIG. 5A, by with a plan view of the exit face, 56, in FIG. 5B, suitable for creating separate, multiple jets of liquid fuel. Preferably the wet steam nozzle is also a similar multi-hole nozzle with at least as many separate holes and jets as the liquid fuel nozzle. Liquid fuel enters via the passage, 57, flows into the nozzle entry passages, 58, 59, with on-off valves, 60, 61, and thence is accelerated through the separate nozzles, 62, 63, to create the diverging separate fuel trajectories, 64, 65. These separate trajectories can diverge symmetrically away from the combined jet centerline, 66, in their direction of motion, in order to assure a radial component of motion of the liquid fuel and wet steam mixture portions created at the trajectories intersections. The net liquid fuel flow rate can be adjusted in steps, by opening or closing the valves, 60, 61.

15. Where the fuel and steam trajectories intersect thusly, at high relative velocities, the liquid fuel is broken up and atomized into many small liquid fuel droplets. The intersection angle between fuel and steam trajectories creates a component of motion, of the resultant mixture of liquid fuel and steam, radially outward from the centerline, 7, of the liquid fuel jet, 5, as shown by the arrows, 14, and this motion component moves the liquid fuel and steam mixture out of the atomization chamber, 3, and into the surrounding mixer chamber, 12.

16. It is desired that the atomized liquid fuel droplets in the mixture of liquid fuel and steam created in the atomization chamber be on average very small, so that a large fuel surface area is available for the subsequent efficient burning of the fuel inside an engine combustion chamber. Maximum atomizing force, and hence minimum liquid fuel particle size, result with opposed flow of the liquid fuel jet and the steam jet, as shown in FIG. 1, and with high values of both the liquid fuel velocity and the wet steam velocity. So that the mixture of liquid fuel and steam, thusly created in the atomization chamber, will possess an adequate component of radial outward motion, the liquid jet momentum and the steam jet momentum are preferably roughly equal.

17. It is further desired that the atomized liquid fuel droplets become coated with a film of adherent liquid water, so that collisions between liquid fuel particles will not cause them to coagulate and become larger particles. For this purpose the steam, supplied at high pressure to the steam nozzle, 8, is preferably sufficiently wet, with liquid water, that it remains wet throughout the steam nozzle expansion process and subsequent atomization process of mixing with the liquid fuel. If necessary, additional liquid water can be added, at high pressure, into the steam prior to the steam flow into the steam nozzle, as shown at 15 on FIG. 1, to achieve this preferred adequately wet steam. So that liquid water will adhere to the atomized liquid fuel droplets, it may sometimes be preferred to add suitable surfactant materials into the liquid fuel, prior to the fuel flow into the fuel nozzle, as shown at 16 on FIG. 1. For this purpose suitable surfactant would be those capable of increasing the force acting between liquid water and a liquid fuel surface.

18. Mixer liquid water from a source, 17, is delivered into the mixer chamber, 12, via the mixer water pipe, 18, to mix with the mixture of atomized liquid fuel and steam moving radially outward from the atomization chamber, 3, into the mixer chamber, 12. The mixer chamber enclosure, 13, together with the liquid materials contained therein, is rotated by the rotator, 19, at a sufficient speed that the liquid contents remain outside of the atomization chamber due to the centrifugal force of this rotation. The steam in the mixture of liquid fuel droplets and steam leaving the atomization chamber can be largely condensed to liquid water by the mixer water. In consequence a slurry of atomized liquid fuel droplets, suspended within a continuous water portion, is formed within the mixer chamber. This slurry is kept out of the atomization chamber, where it would otherwise disrupt the atomization process, by the centrifugal force caused by rotation of the mixer enclosure, 13. The slurry of liquid fuel and liquid water is removed from the mixer chamber via a removal pipe, 20, and transferred into a slurry receiver, 21.
19. Since the continuous phase of the liquid fuel in liquid water slurry created by this invention is water, flow resistance is low. Thus this slurry can be readily injected into small bore diesel engines at moderate injection pressures and velocities, so that wall impingement need not occur. Very fine liquid fuel atomization to small particles, and the large fuel surface area needed for efficient combustion, are nevertheless obtained, since the liquid fuel was pre-atomized outside of the engine in a steam fuel slurrifier of this invention. This is a principal beneficial object of this invention, that high viscosity and residual type fuels can be efficiently burned in small and medium bore diesel engines by preatomizing the fuel in a steam fuel slurrifier of this invention.

A. Liquid Fuels

In principal any liquid fuel, largely insoluble in water, could be preatomized in a steam fuel slurrifier of this invention. However, if low viscosity, distillate type fuels such as conventional number 2 diesel fuels, were thusly preatomized, appreciable fuel portions would also be prevaporized, and thus not available in the liquid slurry fuel going into the engine. Thus the preferred fuels for use in a steam fuel slurrifier of this invention are high viscosity, residual type fuels, from which almost all volatile components have been removed by prerefining. Also preferred as fuels are naturally occurring residual fuels, such as are derived from tar sands, which are largely devoid of volatile components. These residual type fuels are also preferred as of low price, due to the present difficulty of efficiently burning them in engines.

When residual type fuels containing some volatile components are slurrified in this invention, the original fuel will undergo a form of steam distillation within the atomization chamber, and volatile components will be evaporated there. These evaporated portions can be pumped out of the atomization chamber as gases and subsequently recovered by cooling and condensation outside of the steam fuel slurrifier.

The total liquid inflow rate into the mixer chamber, 12, comprising the liquid fuel, the condensed steam and the mixer water, is to be removed as a slurry at an equal rate, via the removal pipe, 20, in this FIG. 1 example of the invention.

Slurry outflow can be increased or decreased to match total liquid inflow into the mixer chamber by increasing or decreasing correspondingly the speed at which the mixer enclosure, 13, is rotated by the rotator, 19, thus increasing or decreasing the centrifugal pressure in the mixer chamber acting to force slurry out through the removal pipe, 20.

B. Centrifuge Separator

When a slurry of liquid fuel droplets suspended in liquid water is injected and burned in a diesel engine combustion chamber, the water portion is evaporated and leaves the engine as steam during exhaust. Thus a portion of the fuel heating value is lost to latent heat of evaporation of the slurry water and engine efficiency is reduced. Hence it is preferred to use reasonably low ratios of water to fuel in the slurry of liquid fuel in liquid water used in an engine. A centrifuge separator can be used to reduce the water content of the slurry entering the slurry receiver, 21, which can itself comprise the centrifuge separator. Alternatively the rotating mixer enclosure can additionally function as a centrifuge separator to remove a portion of the water from the slurry of liquid fuel in liquid water. Such centrifuge separation of a water portion can only occur with liquid fuels of a density different than the density of water, and some residual fuels have nearly the same density at room temperature as water. However, at the elevated temperature which the slurry acquires in the mixer chamber due to steam condensation, most petroleum residual type fuels will be less dense than the water in the slurry.

Figure 2:
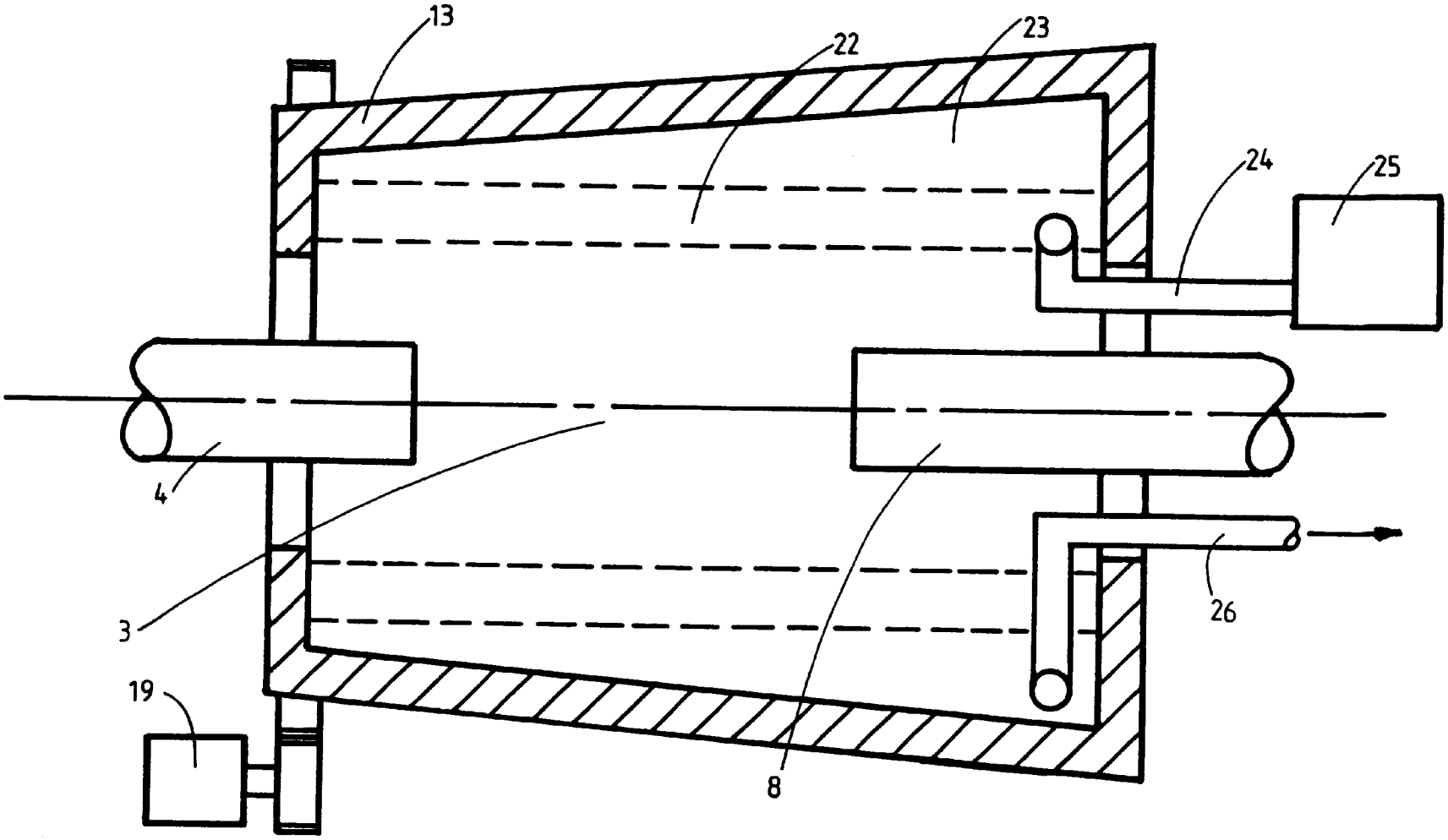

An example of a combined mixer chamber and centrifuge separator form of this invention is shown partially and schematically in FIG. 2 and comprises:

20. The liquid fuel nozzle, 4, steam nozzle, 8, atomization chamber, 3, mixer enclosure, 13, mixer enclosure rotator, 19, are similar to and function similarly to these elements, as described hereinabove, for the FIG. 1 form of the invention.
21. The mixer enclosure, 13, is rotated by the rotator, 19, at a sufficient speed to separate the mixture of liquid fuel droplets in liquid water into a concentrated slurry portion, 22, and a denser water portion, 23.
22. The thusly concentrated slurry of liquid fuel droplets in liquid water is removed from the centrifuge via a removal pipe, 24, and transferred into a concentrated slurry receiver, 25.
23. The liquid water, thusly removed from the slurry, is removed from the centrifuge via a water removal pipe, 26. This removed water can, in principal, be reused as mixer water after being cooled to a lower temperature.
24. A very simple form of centrifuge separator is shown in FIG. 2, but more complex and more effective centrifuge separators can alternatively be used for the purposes of this invention, such as are described in the reference, "Industrial Centrifugation Technology," W. Woon and F. Leung, 1998, McGraw-Hill.

C. Slurrifier Process

The schematic diagram of FIG. 3 illustrates the process steps of this invention, for creating a slurry of liquid fuel in liquid water, these steps comprising:

25. Liquid fuel at high pressure is accelerated up to a high velocity fuel trajectory into the atomization chamber as step 1;
26. Concurrently wet steam at high pressure is accelerated up to a high velocity steam trajectory into the atomization chamber as step 2;
27. The fuel trajectory is intersected by the steam trajectory, within the atomization chamber, to create a mixture of atomized liquid fuel droplets and wet steam, possessing a component of motion outward from the atomization chamber, and into the surrounding enclosed mixer chamber as step 3;

28. Mixer water is added into the mixer chamber and mixes with the mixture of liquid fuel droplets and wet steam, causing steam condensation, and thusly creating a slurry of liquid fuel droplets in liquid water as step 4;
29. The slurry of liquid fuel droplets in liquid water can be transferred into a slurry receiver as step 6.
30. Concurrently the mixer chamber enclosure, together with the liquid contents thereof, are rotated at a sufficient speed that the resultant centrifugal force keeps the slurry outside the atomization chamber, where it would otherwise disrupt the atomization process, as step 5;
31. In some applications of this invention the slurry receiver can be rotated, as a centrifugal separator, to remove a portion of the liquid water from the slurry, in order to create a concentrated slurry of liquid fuel in liquid water as step 7. The thusly concentrated slurry is transferred out of the rotating slurry receiver and into a concentrated slurry receiver as step 8. Concurrently the separated water is also removed separately from the rotating slurry receiver;

Supplementary process steps can also be introduced for some applications, into the process of this invention as, for example, the following:

32. Additional liquid water can be mixed into the high pressure steam, prior to step 2, as step 9, to assure that the steam remains adequately wet throughout steps 2 and 3;
33. A surface active material can be introduced into the high pressure liquid fuel, prior to step 1, as step 10, to increase the adhesion of liquid water to the surfaces of the liquid fuel droplets;

D. Sizing

A steam fuel slurrifier of this invention can be sized for slurrifying a desired liquid fuel flow rate, Mf, by estimating the corresponding steam flow rate, MS, and mixer water flow rate, mc. So that the mixture of liquid fuel droplets and steam can move principally radially outward from the atomization chamber into the mixer chamber, the opposed momenta of liquid fuel and steam are preferably approximately equal, hence:

$$\frac{(Mf)}{(MS)} = \frac{(VS)}{(VF)} = (VR)$$

Wherein:

(Mf)=liquid fuel mass flow rate;

(MS)=wet steam mass flow rate;

(VS)=wet steam velocity entering the atomization chamber;

(VF)=liquid fuel velocity entering the atomization chamber;

(VR)=velocity ratio and mass ratio of fuel and steam;

The unit atomizing force and hence the fineness of liquid fuel atomization is approximately proportional to the square of the sum of liquid fuel velocity and wet steam velocity, for a particular atomization chamber pressure, hence:

$$(FA)=K[(VS)+(VF)]^2=K(VF)^2[(VR)+1]^2$$

Wherein:

(FA)=unit atomizing force

K=a constant dependent upon atomization chamber pressure and the geometry of intersection of the liquid fuel and steam jets;

In principal any value of liquid fuel velocity can be used by increasing the liquid fuel pressure at entry to the fuel nozzle, higher pressures creating higher velocities and finer atomization of the liquid fuel. Liquid fuel velocity (VF) and wet steam velocity (VS) can be estimated from fuel and steam supply pressures and densities by methods well known in the art of fluid mechanics.

The preferred wet steam quality at nozzle entry, can be estimated by assuming that the steam is to remain wet throughout the roughly reversible nozzle expansion step, followed by the essentially throttling atomization step, so that liquid water will always be available to coat the surface of the liquid fuel droplets. Heat transfer from steam to liquid fuel can be ignored for this estimate, since such heat transfer may be appreciably slower than the atomization process. This estimation of wet steam quality at nozzle entry, together with an estimate of any needed water additions to the steam prior to nozzle entry, can be made by methods well known in the art of steam flow and steam boilers.

Preferably sufficient mixer water is added into the mixer to condense essentially all of the steam to liquid water. This mixer water flow rate, mc, can be estimated via a conventional energy balance on the entire slurrifier, thus including the heat transferred from the steam into the liquid fuel. The temperature of the slurry of liquid fuel and liquid water, within the mixer chamber, can be approximated as the saturated steam temperature at atomization chamber pressure.

The mass ratio of liquid fuel to liquid water in the slurry within the mixer chamber is approximately as follows, for full condensation of the steam:

$$\frac{(MF)}{(mw)} = \frac{(MF)}{(MS) + (\mathrm{mc})}$$

Wherein (mw) is the total water content of the slurry;

The mixer enclosure is to be rotated at a speed sufficient to keep the slurry out of the atomization chamber. This speed will depend upon the geometry and orientation of the mixer enclosure, and can best be determined experimentally. For example, for a mixer enclosure rotated about a horizontal centerline the minimum required rotational speed can be approximated as:

$$(N) = \sqrt{\frac{(X)}{(R)}}$$

Wherein:

(N)=least mixer enclosure rotational speed;

(R)=minimum radius of slurry from axis of enclosure rotation;

(X)=a constant dependent on the units used; for N in revolutions per minute, and R in feet (X)=2933

Any consistent system of units can be used in these approximate sizing relations;

Final slurrifier dimensions and operating conditions can be more closely determined experimentally.

E. Beneficial Objects

A principal beneficial object of this invention is to create a slurry of liquid fuel droplets in a continuous water phase, wherein the liquid fuel droplets are not only preatomized by steam but are also precoated with a liquid water film, created by steam condensing thereon during the atomization. Subsequent collisions between liquid fuel droplets are unlikely to lead to coagulation from desired small droplets into undesirable large droplets, since the liquid water film keeps the liquid fuel droplets from making contact with each other. This liquid water cushioning of the liquid fuel droplet collisions can be augmented, where necessary, by use of fuel soluble surfactants which act to increase adhesion of the liquid water precoat to the liquid fuel surface.

The slurry of liquid fuel droplets in liquid water created by the steam fuel slurrifiers of this invention can be efficiently burned in small and medium bore diesel engines, since the large fuel surface area needed is created by the preatomization of the fuel outside of the engine. Hence only moderate fuel injection pressures, and thus low injection path length, can be used with these fuels.

Engine efficiency is reduced by the necessity of evaporating the water portion of the slurry. By reducing the liquid water content of the slurry, as by use of a centrifuge separator, this efficiency loss can be minimized. This efficiency loss is partially offset by the reduced exhaust emissions of oxides of nitrogen, an acid rain component, resulting from the lowered values of average peak combustion temperatures, due to the evaporation of the water portion of the slurry.

F. Use of surfactant materials

Use of fuel soluble surface active agents, surfactant, may be preferred in some applications to increase the adhesion of steam condensate to the liquid fuel droplets. More firmly adhered water can act to prevent coalescence and coagulation of the atomized liquid droplets, and thus to stabilize the slurry of liquid fuel droplets in the continuous water phase. A very large number of surfactant materials are commercially available (see for example, "Encyclopedia of Surface Active Agents," J. P Sisley and P. J. Wood, Chem. Publ. Co., New York, 1961). Selection of suitable surfactant for use with this invention is preferably based on experiments with the fuel type to be used, since these materials tend to be very specific in their effectiveness, which is difficult to predict from theoretical principals.

Having thus described my invention, what I claim is:

1. A steam fuel slurrifier for creating liquid fuel in liquid water slurries, and comprising:

an atomization chamber at an atomization chamber pressure;

a source of liquid fuel at pressure greater than said atomization chamber pressure;

a source of wet steam at a pressure greater than said atomization chamber pressure;

at least one liquid fuel nozzle means for connecting said liquid fuel source to said atomization chamber, so that: from each said liquid fuel nozzle means, a liquid fuel jet is forced into said atomization chamber, by the pressure difference between said fuel source and said atomization chamber; the line of motion, followed by each portion of said liquid fuel jet, within said atomization chamber, being the trajectory of that fuel jet portion; and so that: the line of motion followed by the center of mass of all liquid jet portions which passed concurrently through said at least one liquid fuel nozzle means being the centerline of said liquid fuel jets; and further so that: the velocity of liquid fuel portions along their trajectories increases as said pressure difference between said liquid fuel source and said atomization chamber is increased;

a number of steam nozzle means for connecting said wet steam source to said atomization chamber, said number at least equaling the number of said liquid fuel nozzle means, so that: from each steam nozzle means a wet steam jet is forced into said atomization chamber by the pressure difference between said steam source and said atomization chamber, the line of motion followed by each portion of said wet steam jet, within said atomization chamber, being the trajectory of that steam jet portion; and so that the line of motion followed by the center of mass of all wet steam jet portions which passed concurrently through said number of steam nozzle means being the centerline of said steam jets; and further so that: the velocity of wet steam portions along their trajectories increases as said pressure difference between said steam source and said atomization chamber is increased;

a mixer chamber, surrounding said atomization chamber, and open to said atomization chamber, and comprising a mixer enclosure surrounding said mixer chamber;

alignment means for aligning said at least one fuel nozzle means and said number of steam nozzle means, relative to each other and to said mixer chamber, so that:

the trajectory of each portion of said liquid fuel jet is intersected by the trajectory of a portion of said wet steam jet, each such trajectories' intersection creating a portion of a mixture of wet steam and liquid fuel;

and so that: each said mixture portion of wet steam and liquid fuel has a resultant component of velocity radially outward from said centerline of said at least one liquid fuel jet, which moves each said mixture portion out of said atomization chamber and into said surrounding mixer chamber;

a source of mixer liquid water;

mixer water means for delivering mixer liquid water from said mixer water source into said mixer chamber, so that said mixer water mixes with said mixture of wet steam and liquid fuel moving radially outward from the centerline of said liquid fuel jets, whereby a slurry of liquid fuel in liquid water is created;

rotator means for rotating said mixer enclosure, so that a centrifugal force is created, which acts upon said slurry of liquid fuel in liquid water, sufficient to retain said slurry outside of said atomization chamber;

a slurry receiver means for receiving said slurry of liquid fuel and liquid water;

removal means for removing said slurry of liquid fuel and liquid water from said mixer chamber and transferring it into said slurry receiver.

2. A steam fuel slurrifier for creating liquid fuel in liquid water slurrys, as described in claim 1:

and further comprising:

a concentrated slurry receiver;

wherein said slurry receiver further comprises slurry receiver rotator means for rotating said slurry receiver as a centrifuge, so that; a portion of liquid water is separated out of said slurry of liquid fuel and liquid water, and so that said separated liquid water portion can be separately removed from said rotating slurry receiver, and further so that the remaining slurry of liquid fuel and liquid water can be separately removed from said rotating slurry receiver and transferred into said concentrated slurry receiver.

3. A steam fuel slurrifier as described in claim 1:

wherein said liquid fuel in said source of liquid fuel comprises an added surface active material.

4. A steam fuel slurrifier as described in claim 1, and further comprising:

a source of added liquid water;

water addition means for adding said added liquid water into said wet steam, prior to flow of said steam into said steam nozzle, so that a steam water mixture is created, whose liquid water content is sufficient that said steam water mixture would remain wet if throttled to atomization chamber pressure.

5. A steam fuel slurrifier as described in claim 1, and further comprising:

a source of added liquid water;

water addition means for adding said added liquid water into said wet steam, prior to flow of said steam into said steam nozzle, so that a steam water mixture is created, whose liquid water content is sufficient that said steam water mixture would remain wet when throttled to atomization chamber pressure;

wherein said liquid fuel in said source of liquid fuel, comprises an added surface active material.

6. A process for creating a slurry of liquid fuel in liquid water, and comprising the steps of:

accelerating a liquid fuel from a source up to a velocity, in a liquid fuel jet within an atomization chamber, and each portion of said liquid fuel moving along a line of motion, which describes the fuel trajectory of that fuel portion;

concurrently accelerating wet steam from a wet steam supply source, up to a velocity, in a wet steam jet within said atomization chamber, each portion of said wet steam moving along a line of motion, which describes the steam trajectory of that wet steam portion;

intersecting each said fuel trajectory with a steam trajectory, within said atomization chamber, whereby a mixture portion of liquid fuel and wet steam is created;

moving each said mixture portion of liquid fuel and wet steam out of said atomization chamber and into a mixer chamber surrounding said atomization chamber;

adding mixer liquid water from a mixer water source, into all said mixture portions of liquid fuel and wet steam within said mixer chamber, whereby a slurry of liquid fuel and liquid water is created;

concurrently rotating said slurry of liquid fuel and liquid water within said mixer volume at sufficient rotational speed to keep said slurry outside of said atomization chamber;

removing said slurry of liquid fuel and liquid water from said mixer chamber and transferring it into a slurry receiver.

7. A process for creating a slurry of liquid fuel in liquid water, as described in claim 6, and further comprising the step of:

rotating said slurry receiver as a centrifuge, at a speed sufficient to separate a portion of liquid water out of said slurry of liquid fuel and liquid water, and removing said separated liquid water portion out of said rotating slurry receiver and removing the remaining slurry of liquid fuel and liquid water out of said rotating slurry receiver and transferring it into a concentrated slurry receiver.

8. A process for creating a slurry of liquid fuel in liquid water, as described in claim 6, and further comprising the step of:

mixing a surface active material into said liquid fuel, prior to said step of accelerating said liquid fuel up to a velocity into said atomization chamber.

9. A process for creating a slurry of liquid fuel in liquid water, as described in claim 6, and further comprising the step of:

mixing additional liquid water into said steam, prior to said step of accelerating said steam up to a velocity into said atomization chamber.

10. A process for creating a slurry of liquid fuel in liquid water, as described in claim 6, and further comprising the steps of:

rotating said slurry receiver as a centrifuge, at a speed sufficient to separate a portion of liquid water out of said slurry of liquid fuel and liquid water, and removing said separated liquid water portion out of said rotating slurry receiver, and removing the remaining slurry of liquid fuel and liquid water out of said rotating slurry receiver and transferring it into a concentrated slurry receiver;

mixing additional liquid water into said steam, prior to said step of accelerating said steam up to a velocity into said atomization chamber;

mixing a surface active material into said liquid fuel, prior to said step of accelerating said liquid fuel up to a velocity into said atomization chamber.

* * * * *

UNITED STATES PATENT AND TRADEMARK OFFICE

CERTIFICATE OF CORRECTION

PATENT NO. : 6,444,000 B1
DATED : September 3, 2002
INVENTOR(S) : Joseph Carl Firey It is certified that error appears in the above-identified patent and that said Letters Patent is hereby corrected as shown below:

Column 3,
Lines 2, 37, 43 and 46, change “6”, to -- 10 --;
Lines 14, 41, 45 and 47, change “10”, to -- 6 --;

Signed and Sealed this

Fourth Day of March, 2003

JAMES E. ROGAN
*Director of the United States Patent and Trademark Office*